United States Patent [19]

Dorn

[11] 4,170,298

[45] Oct. 9, 1979

[54] "L" SHAPED CONTOUR CARTON

[75] Inventor: Gary H. Dorn, Columbus, Ind.

[73] Assignee: Champion International Corporation, Stamford, Conn.

[21] Appl. No.: 928,062

[22] Filed: Jul. 26, 1978

Related U.S. Application Data

[63] Continuation of Ser. No. 829,717, Sep. 9, 1977, abandoned.

[51] Int. Cl.[2] ..... B65D 85/54

[52] U.S. Cl. ..... 206/326; 206/491; 229/27

[58] Field of Search ..... 229/27, 40, 29 D, 29 E, 229/42, 15; 206/491, 521, 45.11, 320, 326

[56] References Cited

U.S. PATENT DOCUMENTS

| | | | |
|---|---|---|---|
| 268,638 | 12/1882 | Susini-Ruiseco | 229/27 |
| 2,015,278 | 9/1935 | Meyer | 229/27 |
| 2,331,753 | 10/1943 | Wohlers | 206/326 |
| 2,675,955 | 4/1954 | Gibbons | 206/326 X |
| 2,774,468 | 12/1956 | Rous | 229/27 X |
| 2,791,363 | 5/1957 | Boeye | 206/491 X |
| 2,832,525 | 4/1958 | Cavin | 206/326 X |
| 3,027,061 | 3/1962 | Locke | 206/491 X |
| 3,145,902 | 8/1964 | Nolen | 229/42 X |
| 3,871,520 | 3/1975 | Hand | 206/320 |
| 3,977,592 | 8/1976 | Gorham | 229/15 |
| 3,978,982 | 9/1976 | Duncan | 206/326 |
| 4,111,301 | 9/1978 | English | 206/326 |

FOREIGN PATENT DOCUMENTS

| | | | |
|---|---|---|---|
| 227603 | 3/1963 | Austria | 206/326 |

*Primary Examiner*—Stephen P. Garbe
*Attorney, Agent, or Firm*—Evelyn M. Sommer

[57] ABSTRACT

A unitary paperboard blank for construction of an "L" shaped shipping carton for an irregularly shaped article such as a rocking chair comprises appropriately folded panels forming the top, rear, bottom, front, first knee and second knee carton surfaces. The sides are formed by closure of cushioned flaps which are pivotally articulated at opposite sides of certain of the panels. The "L" shaped carton has at least one inside inverse corner which may be formed of an offset joint and which may be used in conjunction with an extension to secure and protect the enclosed article. The cushioned side flaps may overlap to provide additional protection and the carton may be pre-assembled with the article placed into it from the side, or the article may be placed on the blank and the carton assembled around the article.

6 Claims, 11 Drawing Figures

"L" SHAPED CONTOUR CARTON

This is a continuation of application Ser. No. 829,717, filed Sept. 9, 1977, now abandoned.

BACKGROUND OF THE INVENTION

The present invention relates to a carton blank and a shipping carton for the packaging of an irregularly shaped article. More particularly, the shipping carton is especially adapted for the packaging and protection of "L" shaped articles such as rocking chairs, lawn care equipment, appliances or furniture.

Prior to the present invention irregularly or "L" shaped objects, such as rocking chairs, were frequently packaged using two separate cartons which were joined together after the article was lowered into one of the cartons. Sometimes the chair or other object was lifted and lowered into a first assembled carton and the second carton fastened to the first carton. It required substantial amounts of time and labor to tape, stick and seal the carton pieces in place. The pieces required a number of press runs as well as a relatively large and complex inventory of the carton pieces. Extra labor was required to lift the article up, over and down into the carton. Further, such conventional cartons waste material by positioning carton material over the area least likely to incur damage, for instance, the lap or the bottom of the chair.

OBJECTIVES AND SUMMARY OF THE INVENTION

Accordingly, it is an object of the present invention to provide an irregularly shaped shipping carton which is constructed from a single blank, such single blanks being relatively inexpensive to produce as they require only one press run, and such single blanks being relatively easy to store and inventory as there is only one piece involved.

Another objective of the present invention is to provide such a carton blank from which an irregularly shaped carton can be constructed and sealed using relatively less time and labor on its assembly, taping and stitching.

It is a further objective of the present invention to provide such a carton which gives additional protection for the more vulnerable areas of the article by providing leading and trailing carton blank panels which project inwardly to protect, stabilize and separate the enclosed article.

Another objective of this invention is to provide such a carton having a means for additional side protection by overlapping flaps.

A further objective of this invention is to provide such a carton in which the amount of waste material used to protect areas not likely to incur damage is minimized.

It is a further objective of this invention to provide a carton which may be assembled around the article or alternatively which may be assembled with one side open so that the article may be slid in from the side with substantially less energy than was required in the loading of conventional cartons.

In accordance with the present invention a one-piece carton blank is provided having top, rear, bottom, front, first knee and second knee panels. The carton sides are formed by closure of the cushioned flaps articulated from the panels, those flaps also constituting integral portions of the carton blank. These flaps may overlap substantial amounts to provide extra side protection. At least one corner of the carton is an inside or inverted corner which may be used to establish leading and/or trailing edge extensions to secure and protect the enclosed article. The unitary carton blank (one piece construction) assures minimal inventory, and relatively low cost, and relatively easy assembly.

It is a feature of the present invention to provide a unitary one piece paperboard blank for erection into an "L" shaped shipping container for an irregularly shaped article, such as a rocking chair. The carton blank comprises a plurality of rectangular panels which are consecutively articulated and lie along a common axis, said panels being a bottom panel, a front panel, a first knee panel, a second knee panel, a top panel and a rear panel. The blank also has a leading edge portion and a trailing edge portion adapted to be connected in an inverse corner at the junction of the first knee panel and the second knee panel and a plurality of fold lines forming converse corners between the other panels. A plurality of flaps are articulated upon fold lines from opposite free sides of certain of the panels. When those flaps are bent inwardly upon assembly of the carton, they define a closed or partially open space.

DESCRIPTION OF THE INVENTION

Figure 1:
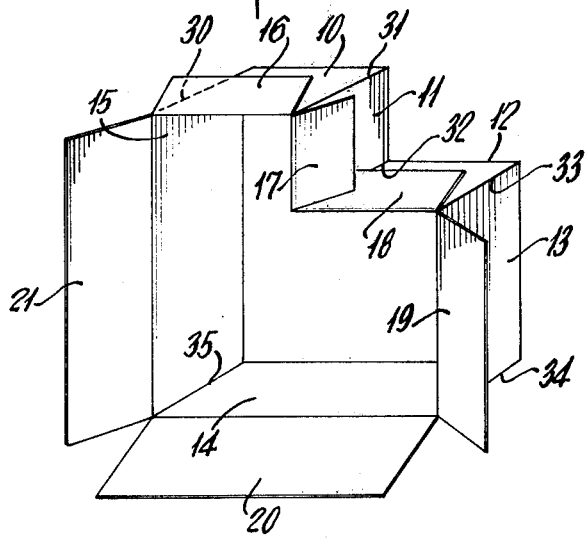
FIG. 1 is a side perspective view of an "L" shaped contour carton of the first embodiment of the present invention.
Figure 11:
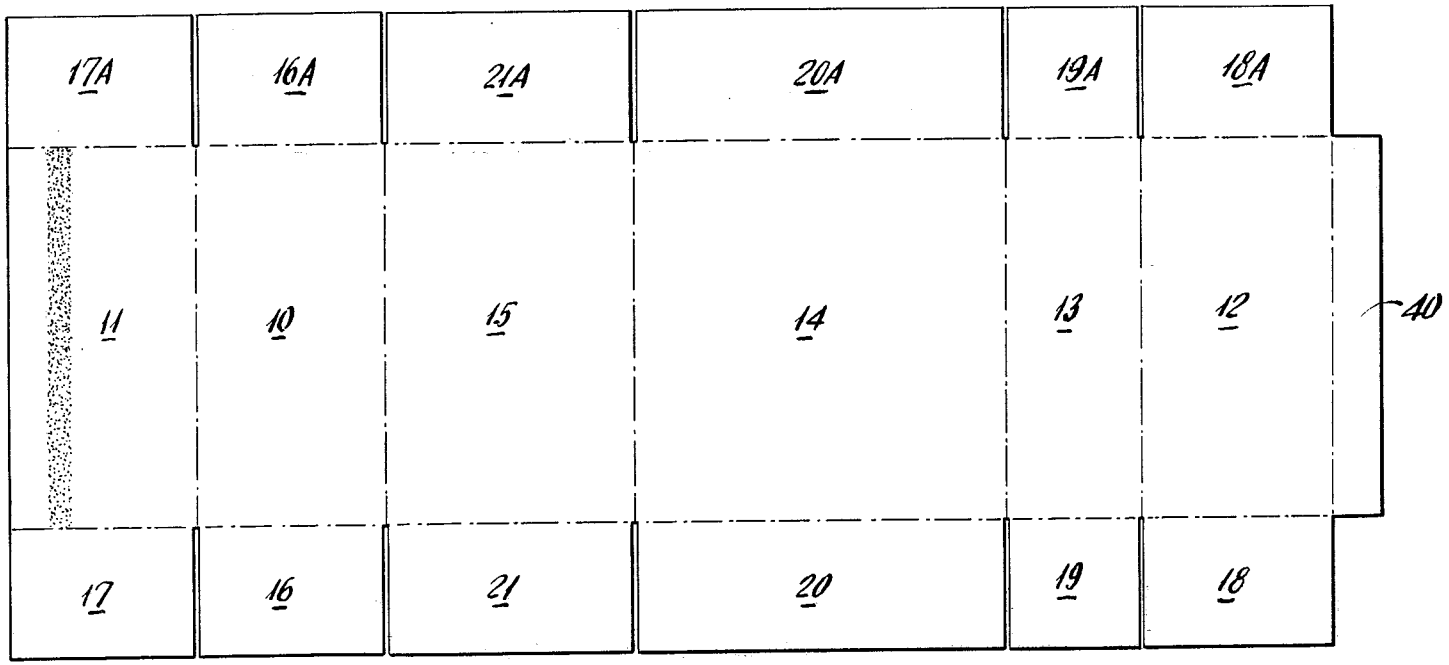
FIG. 11 is a diagram of the paperboard blank which corresponds to the carton of FIG. 1.

An assembled "L" shaped contour carton is shown in FIG. 1. This is a preferred embodiment of the carton in that all of the angles between the various flaps of the assembled carton are 90° when the carton is assembled, i.e., "squared up." Accordingly, the front panel 13 is connected and perpendicular to both the second knee panel 12 and the bottom panel 14. The front panel 13 is parallel to the rear panel 15 and to the first knee panel 11. The second knee panel 12 is connected and perpendicular to the front panel 13 and to the first knee panel 11 and is parallel to the bottom panel 14. Similarly, the top panel 10 is connected and perpendicular to both the rear panel 15 and the first knee panel 11 and is parallel to the bottom panel 14. All of the panels 11–15 are rectangular when viewed in top view as seen in FIG. 11.

The front carton flaps 16–21 are appended to the respective carton panels 10–15 and may be appropriately folded (closed) to form a closed space. More particularly, the front flap 19 is appended to the front panel 13, the second knee flap 18 is appended to the second knee panel 12, the first knee flap 17 is appended to the first knee panel 11, the top flap 16 is appended to the top panel 10, the rear panel flap 21 is appended to the rear panel 15 and the bottom flap 20 is appended to the bottom panel 14.

The rear side flaps 16A–21A (not shown in FIG. 1) are similarly appended to the opposite side of panels 10–15, with the suffix "A" denoting rear.

Figure 2:
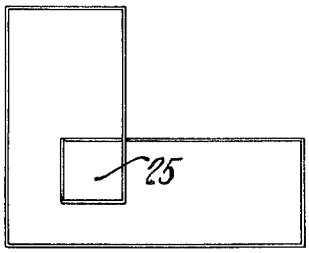
FIG. 2 is a side view of the "L" shaped contour carton of the first embodiment of the present invention.

A closed carton is formed from the carton shell, shown in FIG. 1, by folding the flaps as indicated in FIG. 1. It is important to note that when using the inverse corner contour carton configuration, such as shown in FIG. 1, the side area contiguous to the inverse corner, i.e., the area contiguous to corner joint 32, is susceptible to non-flap coverage. This possible area 25 of non flap coverage is shown in FIG. 2. Special care in flap design must be taken to insure this area has sufficient flap coverage. Several methods are available for this purpose, such as creating extensions of the inverse corner joint so that the side flap may be similarly extended, or increasing the lateral flap width.

Increasing the lateral flap width may also cause the side flaps to overlap and thus provide double coverage of the side areas for better seals, tighter seams and added protection for the enclosed article.

Alternatively, when overlapping flap protection is not required, the flaps which might be articulated from one or more panels can be dispensed with; for example, if both the rear flap 21 and the second knee flap 18 are used as shown, then the top flap 16 may be considered unnecessary. Similarly, if both the second knee flap 18 and the bottom flap 20 are used as shown, then front flap 19 may be considered unnecessary.

Figure 4:
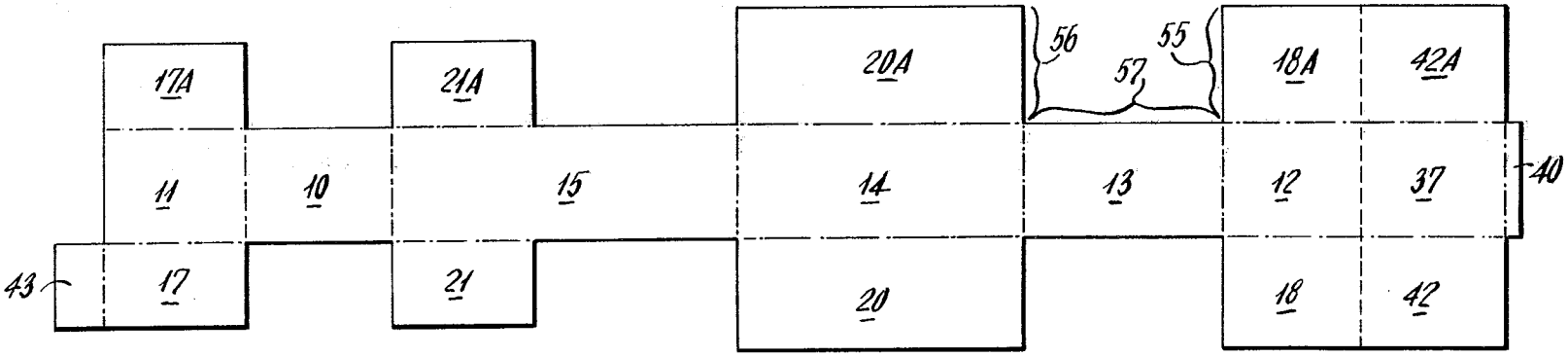
FIG. 4 is a diagram of the paperboard blank which corresponds to the carton of FIG. 3.
Figure 6:
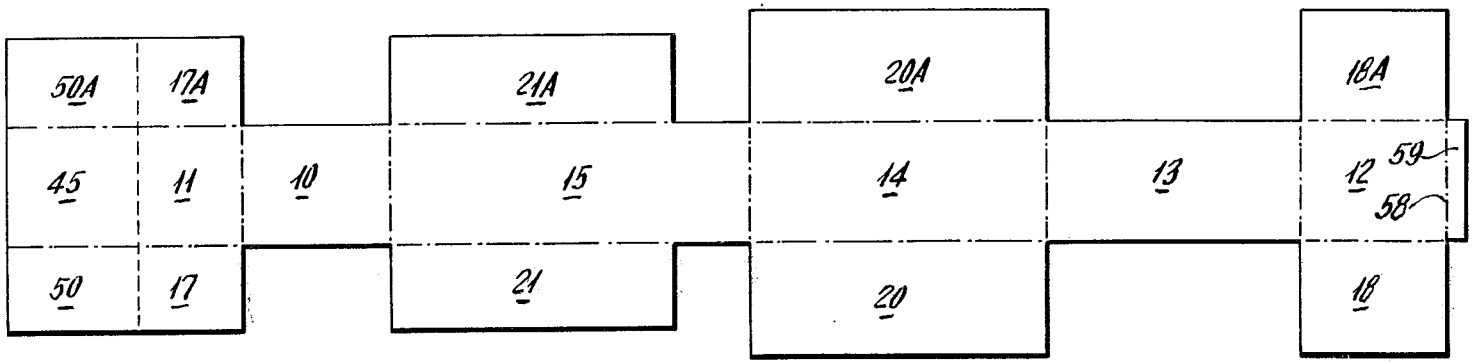
FIG. 6 is a diagram of the paperboard blank which corresponds to the carton of FIG. 5.

The "L" shaped contour carton of FIG. 1 is assembled from the carton blanks of the type shown in FIGS. 4 and 6. The carton blank leading and trailing ends must be joined to form a carton shell enclosure. Although this may be accomplished at any one of the corner lines 30–35, only the inverted corner joint 32 will allow for panel extensions.

Figure 3:
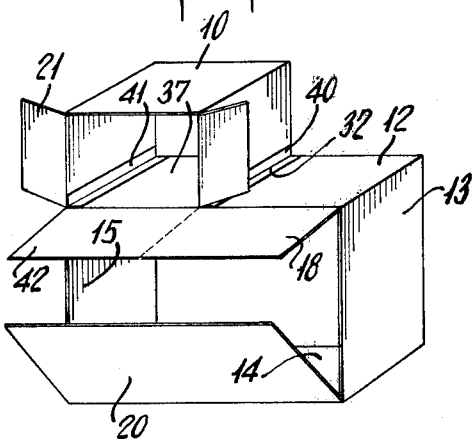
FIG. 3 is a side perspective view of an alternative second embodiment of the present invention which is an "L" shaped contour carton which has a full horizontal extension.

FIG. 3 is a side view of the contour carton with a full horizontal extension 37 and two offset joints 40 and 41. The inverted corner joint 32 may be formed by either taping or stitching the leading and trailing edges together. However, a stronger joint can be created by employing the offset 40, which is formed by extending the first knee panel 11 a few inches, preferably two inches, and folding it to an appropriate angle to contact the second knee panel 12. In this preferred embodiment, the angle of joint 32 is 90° and the other corners are 90° converse corners. The offset 40 is then either glued, stitched or taped to the adjacent first knee panel 11 to form the offset joint 40. This offset joint requires only one line of glueing. taping or stitching where it contacts the adjacent panel and consequently provides a stronger joint than conventional jointing, which requires multiple seam lines at the point of contact.

It will also be seen that forces on this offset inverse corner joint 40 are inward and consequently more easily distributed than forces on a conventional outside corner joint (not shown). Alternatively, the offset joint 40 may be fabricated without extending the panel by the addition of a length of paperboard material which is an "L" shaped cross-section. However, this requires two seam lines and is an additional piece to inventory. Consequently, this is a non-preferred embodiment.

Further, FIG. 3 shows a full horizontal extension 37 which is formed by the inward extension of the second knee panel 12. This horizontal extension 37 may be employed as a stabilizer, brace or separator for the enclosed articles and may provide additional support for extended or oversized flaps.

The flaps 16–21, 16A–21A in general are appended to the carton panels 10–15. As previously mentioned, the area 25 of FIG. 2 is susceptible to being left uncovered by the side flaps. One solution would be to extend a single contiguous flap, for instance, the first knee flap 17, in a lengthwise direction as indicated in FIG. 4, creating the additional flap area 43. Although this additional flap length 43 will cover the area 25 of FIG. 2, it is not appended to a panel along its length and consequently it will have a tendency to deform.

Alternatively, if the second knee panel 12 is lengthened into the horizontal extension panel 37, then the second knee panel side flap 18 may be extended to include the flap 42 which would be appended to the horizontal panel extension 37. In this manner the additional flap area 42 would be fully supported along its length and consequently have less tendency to deform.

As shown in FIG. 4, additional carton side protection can be generated by extending the side flap lateral width 55 or 56. Generally, for non-overlapping flaps, that is, those which just meet to form a closed area, the sum of their lateral widths 55 and 56 must be equal to the length 57 of the adjacent intermediate panel, for instance, 13. Overlapping flaps are created by making the sum 55 and 56 greater than the length of the adjacent intermediate panel 57 but not greater than twice its length.

Although FIG. 3 depicts a full horizontal extension, the same techniques may be used to create full vertical extensions. However, only a full extension can be tied to the opposite wall panel by the offset joints 40. Again, the offset is formed by continuing the extension panel a few inches and folding it to an appropriate angle to contact the opposite wall panel and then glueing, taping or stitching it in place.

Figure 5:
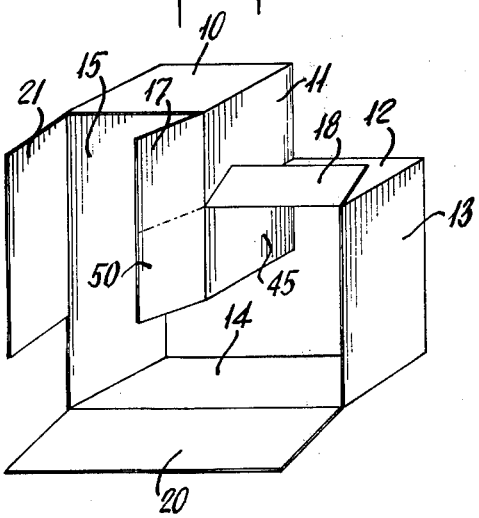
FIG. 5 is a side perspective view of an alternative third embodiment of the present invention which is an "L" shaped contour carton having a partial vertical extension.

FIG. 5 is a side perspective view of an "L" shaped contour carton which utilizes a partial vertical extension. More particularly, first knee panel 11 is lengthened to form the partial vertical extension 45. Similarly, the first knee flap 17 is lengthened to the flap extension 50 and is appended to the partial vertical extension 45.

FIG. 6 is a diagram of the paperboard blank used to assemble the "L" shaped contour carton shown in FIG. 5. The minimal (2") extension 59 of the second knee panel may be bent to an appropriate angle along line 58 to form an offset joint (not shown) between the first and second knee panels.

Figure 7:
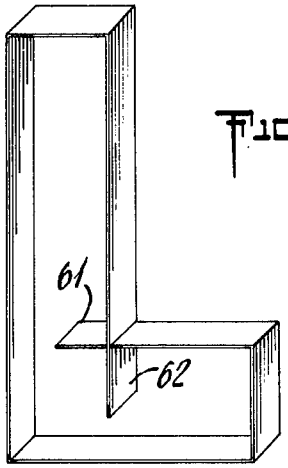
FIG. 7 is a side perspective view of an alternative fourth embodiment of the present invention which is an "L" shaped contour carton which utilizes simultaneous vertical and horizontal extensions.

FIG. 7 is a side perspective view of a contour carton which simultaneously employs both a horizontal extension 61 and a vertical extension 62. Although these are shown as partial extensions, the same techniques will apply equally well to full extensions which may be attached to the opposite carton panel by an offset joint.

Figure 8:
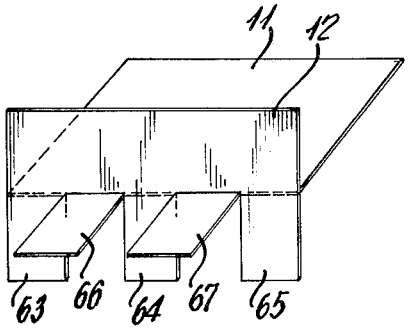
FIG. 8 is a perspective view of the first embodiment of a simultaneous vertical and horizontal extension useful in the carton of FIG. 7 and which is produced by alternating the horizontal.

Simultaneous extensions require special means of implementation. FIG. 8 shows one such method in which the segments 66,67 of the edge of the first knee panel 11 are extended so as to alternate with the segmented extensions 63,64,65 of the second knee panel 12.

Figure 9:
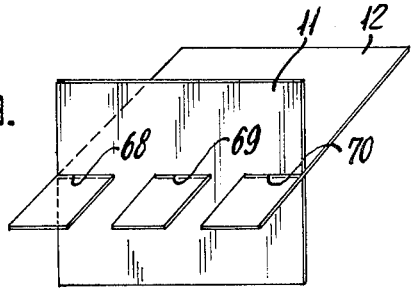
FIG. 9 is a perspective view of the second embodiment of a simultaneous vertical and horizontal extension which is produced by slotting one of the extensions and projecting the tab extension of the other through the slot.

Another method for a simultaneous extension, as shown in FIG. 9 is to extend the first knee panel 11 and cut the slots 68,69,70 in it. The segmented extensions of the second knee panel 12 are inserted through slots 68,69,70 respectively.

Figure 10:
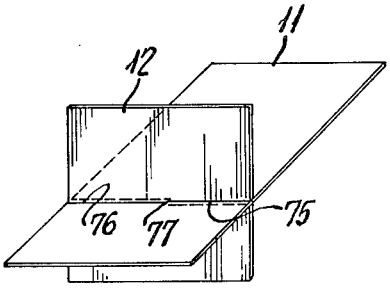
FIG. 10 is a perspective view of the third embodiment of a simultaneous vertical and horizontal extension which is produced by slotting the extensions to form an interlock connection.

Alternatively, both the end knee panels 11,12 may be extended and appropriately cut to form slots 75,76 respectively. The panels are then joined in an interlock connection 77, as shown in FIG. 10.

It is within the scope and contemplation of this invention to fold any of the extensions of FIGS. 3–10 to an appropriate angle to suit the needs of the particular item to be packaged. It is also within the contemplation of this invention to omit one or more segmented or non-segmented extensions.

Although the angles depicted in the foregoing figures and descriptions were 90°, any angle of fold is within the contemplation of this invention provided the carton has at least one inside corner which is between 0° and 180° as measured from the outside of the carton.

What is claimed is:

1. A substantially "L" shaped container having a top portion and a bottom portion, formed from a single sheet of paperboard material, said container comprising:

a first knee panel;

a pair of first knee flaps hingedly connected to the opposite lateral edges of said first knee panel, said pair of first knee flaps closing a portion of said top portion of the container;

a top panel hingedly connected to the top edge of said first knee panel, the opposite lateral edges of said top panel being free;

a back panel hingedly connected to the back edge of said top panel;

a pair of back flaps hingedly connected to the opposite lateral edges of said back panel, said back flaps having a length less than that of said back panel such that a portion of each of the lateral edges of said back panel is free, said back flaps combining with said first knee flaps to fully close the top portion of the container;

a base panel hingedly connected to the bottom edge of said back panel;

a pair of base flaps hingedly connected to the opposite lateral edges of said base panel, said base flaps having a length substantially equal to that of said base panel, said base flaps covering a portion of the bottom portion of the container;

a front panel hingedly connected to the front edge of said base panel, the opposite lateral edges of said front panel being free;

a second knee panel hingedly connected to the top edge of said front panel;

a pair of second knee flaps hingedly connected to the opposite lateral edges of said second knee panel, said second knee flaps having substantially the same length as that of said second knee panel;

a knee extension member coplanar with said second knee panel and hingedly connected to the rear edge of said second knee panel;

a pair of knee extension flaps hingedly connected to the opposite lateral edges of said knee extension member, the length of said knee extension flaps being substantially the same as that of said knee extension member, said knee extension flaps, said second knee flaps, and said base flaps combining to fully close the bottom portion of the container;

means for connecting the bottom edge of said first knee panel to the rear edge of said second knee panel; and means for connecting the rear edge of said knee extension member to said back panel.

2. A substantially "L" shaped container formed from a single sheet of paperboard material, said container comprising:

a first knee panel;

a pair of first knee flaps hingedly connected to the opposite lateral edges of said first knee panel;

a first knee panel extension member coplanar with said first knee panel and connected to the bottom edge of said first knee panel, the bottom edge of said first knee panel extension member being free;

a pair of first knee extension flaps hingedly connected to the opposite lateral edges of said first knee extension member;

a top panel hingedly connected to the top edge of said first knee panel, the opposite lateral edges of said top panel being free;

a back panel hingedly connected to the back edge of said top panel;

a pair of back flaps hingedly connected to the opposite lateral edges of said back panel, said back flaps having a length less than that of said back panel such that a portion of each of the lateral edges of said back panel is free;

a base panel hingedly connected to the bottom edge of said back panel;

a pair of base flaps hingedly connected to the opposite lateral edges of said base panel, said base flaps having a length substantially equal to that of said base panel;

a front panel hingedly connected to the front edge of said base panel, the opposite lateral edges of said front panel being free;

a second knee panel hingedly connected to the top edge of said front panel;

a pair of second knee flaps hingedly connected to the opposite lateral edges of said second knee panel, said second knee flaps having substantially the same length as that of said second knee panel; and means for connecting said second knee panel to said first knee panel; said first and second knee flaps, said first knee extension flaps, said back flaps and said base flaps combining to fully close the container.

3. A substantially "L" shaped container formed from a single sheet of paperboard material as recited in claim 2 in which the means for connecting the second knee member with said first knee member comprises an extension member coplanar with said second knee member and connected thereto, said extension member being receivable in a slot in said first knee member.

4. A one piece blank for erection into an "L" shaped container having a top portion and a bottom portion comprising:

a first knee panel;

a pair of first knee flaps hingedly connected to the top and bottom edges of said first knee panel, said first knee flaps being foldable for closing a portion of the top portion of the container;

a top panel hingedly connected to one lateral edge of said first knee panel, the top and bottom edges of said top panel being free, the opposite lateral edge of said first knee panel being free;

a back panel hingedly connected to one lateral edge of said top panel;

a pair of back flaps hingedly connected to the top and bottom edges of said back panel, said back flaps having a length less than that of said back panel such that a portion of each of the top and bottom edges of said back panel is free, said back flaps being foldable to combine with said first knee flaps to fully close the top portion of the container;

a base panel hingedly connected to one lateral edge of said back panel;

a pair of base flaps hingedly connected to the top and bottom edges of said base panel, said base flaps having a length substantially equal to that of said base panel, said base flaps being foldable to partially close the bottom portion of the container;

a front panel hingedly connected to one lateral edge of said base panel, the top and bottom edges of said front panel being free;

a second knee panel hingedly connected to one lateral edge of said front panel;

a pair of second knee flaps hingedly connected to the tip and bottom edges of said second knee panel, said second knee flaps having substantially the same length as that of said second knee panel;

a knee extension member hingedly connected to one lateral edge of said second knee panel; and a pair of knee extension flaps hingedly connected to the top and bottom edges of said knee extension member, the length of said knee extension flaps being substantially the same as that of said knee extension member, said knee extension flaps, said second knee flaps and said base flaps being foldable to combine to fully close the bottom portion of the container.

5. A one piece blank for erection into an "L" shaped container having a top portion and a bottom portion as recited in claim 4 in which the combined widths of one of said base flaps and one of said second knee flaps is substantially equal to the length of said front panel.

6. A one piece blank for erection into an "L" shaped container comprising:

a first knee panel;

a pair of first knee flaps hingedly connected to the top and bottom edges of said first knee panel;

a first knee extension member hingedly connected to one lateral edge of said first knee panel;

a pair of first extension flaps hingedly connected to the top and bottom edges of said first knee extension member;

a top panel hingedly connected to the other lateral edge of said first knee panel, the top and bottom edges of said top panel being free;

a back panel hingedly connected to one lateral edge of said top panel;

a pair of back flaps hingedly connected to the top and bottom edges of said back panel, said back flaps having a length less than that of said back panel such that a portion of each of the top and bottom edges of said back panel is free;

a base panel hingedly connected to one lateral edge of said back panel;

a pair of base flaps hingedly connected to the top and bottom edges of said base panel, said base flaps having a length substantially equal to that of said base panel;

a front panel hingedly connected to one lateral edge of said base panel, the top and bottom edges of said front panel being free;

a second knee panel hingedly connected to one lateral edge of said front panel; and a pair of second knee flaps hingedly connected to the top and bottom edges of said second knee panel, said second knee flaps having substantially the same length as that of said second knee panel; said first knee flaps, said first extension flaps, said back flaps, said base flaps, and said second knee flaps all being foldable to fully close the container.

* * * * *